US005425695A

United States Patent [19]

Ridgley

[11] Patent Number: 5,425,695

[45] Date of Patent: Jun. 20, 1995

[54] STUFFING TOOL FOR STUFFING DOLLS AND OTHER CREATIONS

[76] Inventor: Delbert R. Ridgley, 985 E. Windsor Cir., Fresno, Calif. 93720

[21] Appl. No.: 279,421

[22] Filed: Jul. 25, 1994

[51] Int. Cl.[6] ..... B25B 23/00

[52] U.S. Cl. ..... 493/373; 493/480; 81/488; 81/436; 81/451; 81/461

[58] Field of Search ..... 493/373, 473, 480; 81/436, 441, 451, 459, 461, 488; 42/95, 70.11

[56] References Cited

U.S. PATENT DOCUMENTS

| | | | |
|---|---|---|---|
| 2,106,741 | 2/1938 | Herbert | 81/441 |
| 3,807,406 | 4/1974 | Rafferty et al. | 128/318 |
| 4,429,599 | 2/1984 | La Sante, Sr. | 81/436 |
| 4,434,688 | 3/1984 | Bowles | 81/451 |
| 4,962,607 | 10/1990 | Baldwin | 42/95 |
| 5,317,827 | 6/1994 | Jaremco | 42/95 |

*Primary Examiner*—Bruce M. Kisliuk

*Assistant Examiner*—E. Morgan

[57] ABSTRACT

The stuffing tool transports and packs stuffing material into cavities of fabric dolls, animals, pillows, or other creations. The three sections of the stuffing tool are: the handle (20), the shaft (30), and the tip section (40).

The handle (20) is made of a rigid material and is attached to the shaft (30) in the normal position of handles.

The shaft (30) is made from a rigid material and is long enough to reach into the normal cavities of fabric dolls, animals, pillows, or other creations.

The tip section (40) is made from a rigid material. The tip section (40) has a series of fluted ridges (40A) which extend outward from the shaft (30), grooves (40B), and a counter-sunk hole (40C) to allow it to grab the stuffing material and transport it to the interior of the cavity.

The stuffing tool is made in several sizes and finishes.

2 Claims, 3 Drawing Sheets

STUFFING TOOL FOR STUFFING DOLLS AND OTHER CREATIONS

BACKGROUND—FIELD OF INVENTION

This invention relates to crafts, specifically to a tool for stuffing fabric creations with fiber or other stuffing material.

BACKGROUND—DISCUSSION OF PRIOR ART

Heretofore, fabric creations were stuffed using any instrument which happened to be at hand. Such things as pencils, knitting needles, chop sticks, hemostats, and similarly shaped objects were used. The problems incurred with these were:

- Previous instruments were awkward and slow and did not allow for ease and efficiency in stuffing items.
- Previous instruments were too smooth and would not grab the stuffing material and transport it into the item often slipping through without moving any stuffing material into the item.
- Previous instruments were too weak and broke or bent under the pressure needed to compact the stuffing material.
- Previous instruments were too pointed and went through the fabric causing a hole.
- Previous instruments had handles which were hard to grip or which poked into the user's hand. Some had no handle at all.
- Previous instruments were too large and would not move between the stuffing material and the fabric to smooth the seam areas as needed.

OBJECTS AND ADVANTAGES

Accordingly, several objects and advantages of my stuffing tool are:

- The stuffing tool allows fast, efficient stuffing of dolls, toys and other items needing to be stuffed.
- The stuffing tool moves the stuffing material into the cavity where it is directed rather than slipping through or past the stuffing material.
- The stuffing tool has a special tip section which is irregular enough to grab the stuffing material and transport it into the item without tearing the fabric under normal stuffing pressure.
- The stuffing tool is strong and will not break or bend under the normal pressure needed to compact the stuffing material.
- The stuffing tool is not pointed and will not readily punch through the fabric causing a hole.
- The stuffing tool has an elongated handle which fits the palm of the hand and allows for comfort while the user applies the pressure needed to pack the stuffing material tightly into the object being stuffed.
- The stuffing tool is small enough to move between the stuffing material and the fabric to smooth the seam areas as needed.
- Further objects and advantages of my stuffing tool will become apparent from a consideration of the drawings and ensuing description.

REFERENCE NUMERALS IN DRAWINGS

20 handle of the stuffing tool
30 shaft of the stuffing tool
40 tip section of the stuffing tool
  40A fluted ridges
  40B grooves
  40C counter-sunk hole

DESCRIPTION FIGURES 1—3

Figure 1:
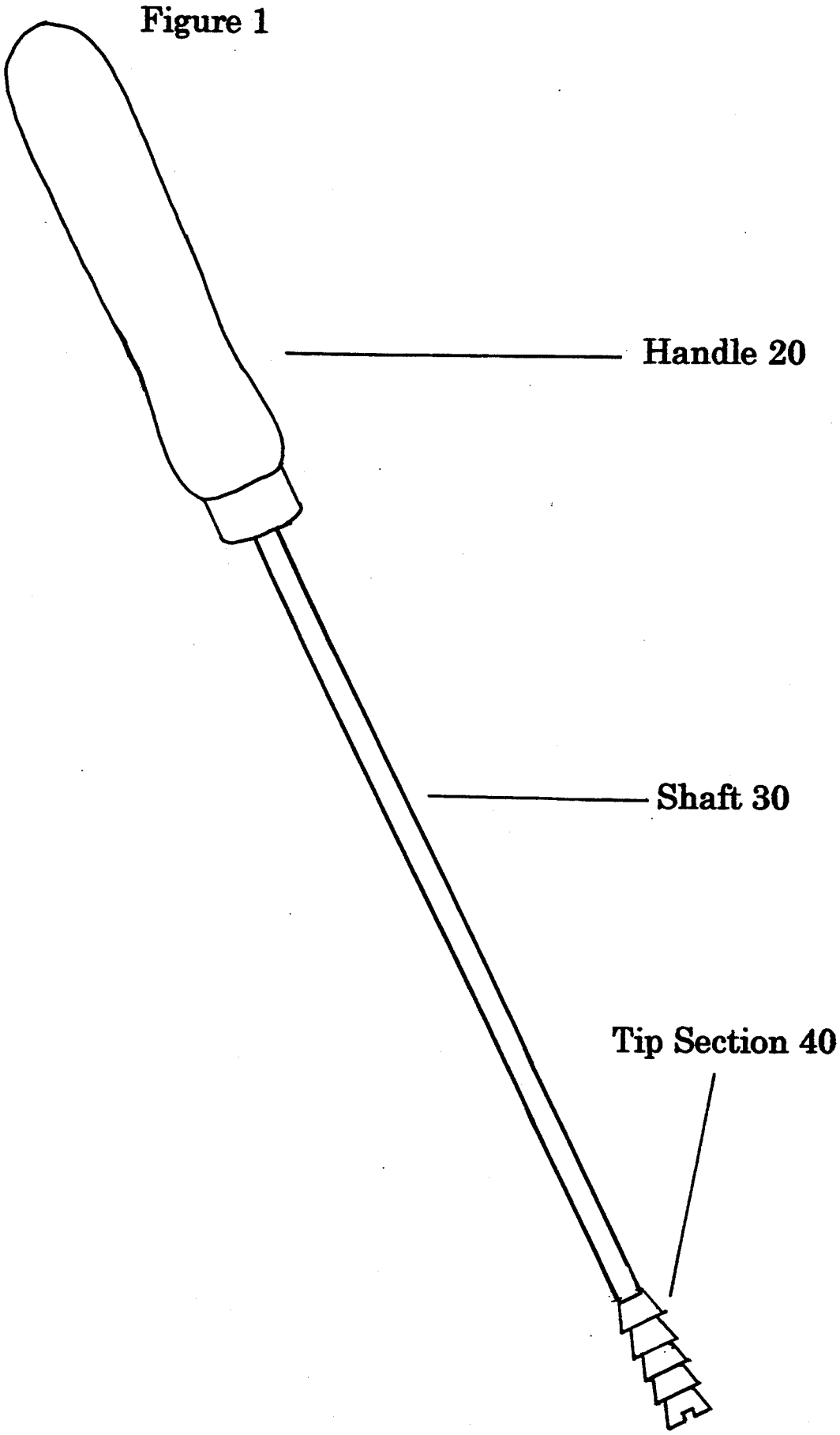
FIG. 1 is a side view of a complete stuffing tool.

A typical embodiment of a stuffing tool is illustrated in FIG. 1, a side view of a complete stuffing tool.

FIG. 1 includes a wooden handle 20 which is 3¾ inches long and 1 inch in diameter at the widest part. It is turned, and has a metal ferrule ⅜ inch wide. There is a 3/16 inch hole bored into the ferruled end of the handle 20. The hole is 1¾ inches deep.

The preferred embodiment of the handle 20 is wood. However, it could also be made from another material such as fiber-glass, plastic or other rigid material.

FIG. 1 includes a shaft 30 which is made from a brass rod 3/16 inch in diameter and 9 inches long. Glue is applied to one end of the shaft 30, and it is pushed into the 3/16 inch hole in the handle 20. The other end of the shaft 30 is threaded with a 12–24 die.

The preferred embodiment of the shaft 30 is brass. However, it could also be made from other metal, fiber-glass, plastic or other rigid material and may be longer or shorter than 9 inches.

Figure 2:
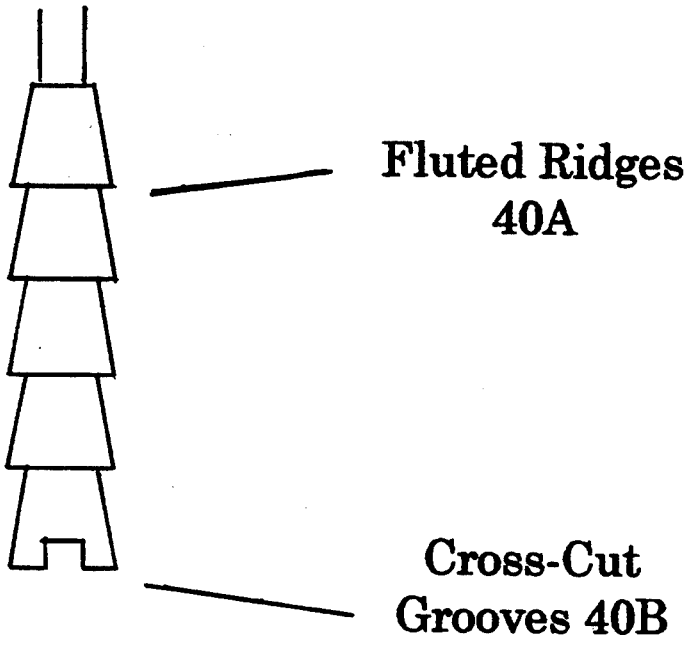
FIG. 2 is a greatly enlarged side view of a tip section.

FIG. 2 is a greatly enlarged side view of a tip section 40. The tip section 40 includes the fluted ridges 40A which extend outward from the shaft 30, the grooves 40B, and the counter-sunk hole 40C.

The tip section 40 is made using a five-banded brass air hose splicer. The center ridge is removed and one of the remaining sections is used for the stuffing tool. This remaining section is threaded on the inside with a 10–32 tap so it can be attached to the shaft 30.

With the fluted ridges 40A facing away from the handle, the threaded end of the shaft 30 is screwed into the tip section 40 to within ¼ inch of the end of the tip section 40. This leaves the tip section 40 with the effect of a counter-sunk hole m the extreme end.

NOTE: The technique of using a thread pattern on the shaft 30 that is different from that used on the tip section 40 allows for a cross-threaded fit that does not require any type of bonding adhesive to create a solid, permanent fit.

The preferred embodiment of the tip section 40 is brass and has five fluted ridges which extend outward from the shaft 30. However, it could also be made from another metal, fiber-glass, plastic or another rigid material. It could also have more or less than five ridges.

Figure 3:
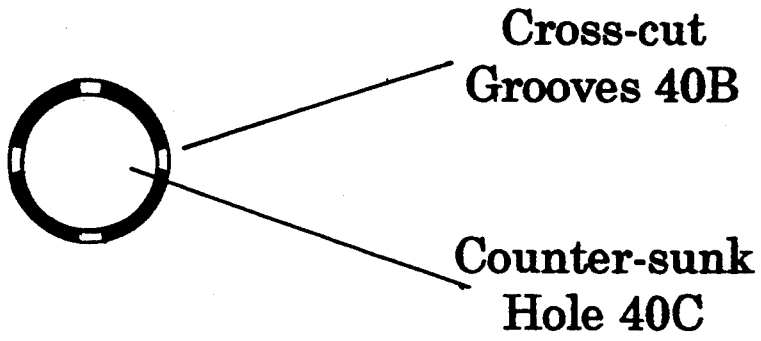
FIG. 3 is an enlarged end view of a cross-cut tip end of a tip section.

FIG. 3 is an enlarged end view of a cross-cut tip of a tip section 40. There is a counter-sunk hole 40C which is ¼ inch deep in the end of the tip section 40. The outside walls are notched with four equidistant grooves 40B which are ⅛ inch deep and 1/32 inch wide.

The preferred embodiment of the tip of the tip section 40 has four equidistant grooves 40B which are ⅛ inch deep and 1/32 inch wide. However, it could have more or fewer grooves 40B cut at various distances and various depths and widths which may or may not be equidistant. Although the preferred embodiment has a counter-sunk hole 40C which is ¼ inch deep, it could be deeper or shallower.

OPERATION OF STUFFING TOOL—FIGURES 1, 2, 3

Basic Use—FIG. 1

The manner of using the stuffing tool is to grasp the object to be stuffed in the left hand (for right-handed person—opposite for left a handed person). With the right hand, place an appropriate amount of stuffing material into the mouth of the cavity to be stuffed. Then with the right hand, grasp the handle 20 of the stuffing tool.

Press the tip section 40 into the stuffing material and push the stuffing material into the deepest recesses of the cavity. Rock the stuffing tool back and forth while pressing into the stuffing material to pack the stuffing material tightly in place. Repeat this process until the item is stuffed and packed sufficiently.

For stuffing small tubular shapes, twirl the stuffing tool in the supply of stuffing material. The fluted ridges 40A, grooves 40B, and counter-sunk hole 40C of the stuffing tool cause the stuffing material to form a tight coil around the stuffing tool. Insert the stuffing tool and the coiled stuffing material into the tube. The stuffing material will release when the stuffing tool is pulled back. Use the tip section 40 of the stuffing tool to pack the coil of stuffing material into place.

Shaft 30—FIG. 1

The shaft 30 of the stuffing tool allows the tip section 40 of the stuffing tool to push the stuffing maternal deep into the cavity and a range it along the seams and inner cavity walls.

Tip Section 40—Fluted Ridges 40A, Grooves 40B, and Counter-sunk Hole 40C—FIGS. 2, 3

The fluted ridges 40A, the grooves 40B, and the counter-sunk hole 40C on the tip section 40 of the stuffing tool work together to transport the stuffing material by grabbing it as the stuffing tool is pushed through the stuffing material. The fluted ridges 40A, the grooves 40B, and the counter-sunk hole 40C guide and pack the stuffing material into the cavity. More stuffing material is added and worked into the cavity with the stuffing tool until the cavity is filled and packed sufficiently.

While I believe that the reason that this stuffing tool transports and packs stuffing material so completely and so easily is because of the fluted ridges 40A, the grooves 40B, and the counter-sunk hole 40C of the tip section 40, I do not wish to be bound by this.

SUMMARY

The stuffing tool allows fast, efficient stuffing of dolls, toys, and other items needing to be stuffed. It has a tip section with fluted ridges which extend outward from the shaft, grooves, and a counter-sunk hole which work together to transport the stuffing material into a cavity.

Furthermore, the stuffing tool has additional advantages in that:

- The stuffing tool does not slip when pushed into the stuffing material and transports the stuffing material into the cavity where it is directed rather than slipping through or past the stuffing material.
- The stuffing tool has a special tip section which is textured enough to grab the stuffing material and transport it into the item being stuffed without tearing the fabric when normal stuffing pressure is applied.
- The stuffing tool is strong and will not break or bend under the normal pressure needed to pack the stuffing material firmly.
- The stuffing tool is not pointed and will not readily punch through the fabric causing a hole.
- The stuffing tool has a smooth, elongated handle which gives the necessary control needed to use it.
- The stuffing tool is small enough to move between the stuffing material and the fabric to smooth the seam areas as needed.
- Further objects and advantages of my stuffing tool will become apparent from a consideration of the drawings and ensuing description.

Accordingly, the reader will see that the stung tool provides a highly reliable, lightweight, yet economical device that can be used by persons of almost any age for the stuffing of any item needing to be stuffed with stuffing material or similar materials.

SCOPE OF INVENTION

Although my above description contains many specificities, these should not be construed as limitations on the scope of the invention, but rather as an exemplification of one preferred embodiment thereof. Many other variations are possible.

For example, the handle can be made from plastic, fiberglass, metal, or other materials and may or may not be painted, stained, varnished, waxed, etc. It could also be somewhat longer or shorter.

Also, the shaft could be made of other plastic, fiberglass, metal, or any rigid material. It could also vary somewhat in length or diameter.

Also, the tip section could be made of other metal, strong plastic, or other material. It could also have more than five fluted ridges or less than five fluted ridges. It could also be cross-cut with grooves deeper or shallower than those described. There could also be more or less than four grooves crossing each other. The grooves could also be in an entirely different pattern such as parallel. The counter-sunk hole could be deeper or shallower.

Thus, the scope of the invention should be determined not by the embodiment(s) illustrated, but by the appended claims and their legal equivalents.

I claim:

1. A hand held tool for transporting and packing stuffing material into cavities, said tool comprising:

a shaft means of predetermined length having a longitudinal axis; a handle means connected to one end of said shaft; and a tip means disposed at a second end of said shaft;

said tip means comprising:

a plurality of fluted ridges flaring out opposite of said handle and away from said shaft, and arranged concentrically about said longitudinal axis; wherein an outer most ridge has at least one notch disposed therein for receiving and transporting said stuffing material.

2. A hand held tool according to claim 1, wherein said tip means contains a countersunk hole which cooperates with said notch for receiving and transporting said stuffing material.

* * * * *